US007198076B2

(12) United States Patent
Wu

(10) Patent No.: US 7,198,076 B2
(45) Date of Patent: Apr. 3, 2007

(54) AIR PUMP ASSEMBLY FOR INFLATING AND DEFLATING AN INFLATABLE ARTICLE

(76) Inventor: Hsin-Tsai Wu, 1F, No. 19, Alley 3, Lane 106, Sec. 3, Min-Chaun E. Rd., Taipei City (TW)

( * ) Notice: Subject to any disclaimer, the term of this patent is extended or adjusted under 35 U.S.C. 154(b) by 223 days.

(21) Appl. No.: 11/068,077

(22) Filed: Feb. 28, 2005

(65) Prior Publication Data

US 2006/0065322 A1 Mar. 30, 2006

(30) Foreign Application Priority Data

Sep. 30, 2004 (CN) ..... 2004 2 0096575

(51) Int. Cl.
*B65B 1/30* (2006.01)

(52) U.S. Cl. ..... 141/197; 141/10; 141/114; 141/192; 5/713; 417/304; 417/313; 417/410.1

(58) Field of Classification Search ..... 141/4, 141/8, 10, 67, 114, 192, 197, 285, 302; 417/304, 417/313, 410.1, 413.1; 5/706, 708, 713; 137/116.3, 109

See application file for complete search history.

(56) References Cited

U.S. PATENT DOCUMENTS

| | | | | |
|---|---|---|---|---|
| 5,035,016 | A * | 7/1991 | Mori et al. | 5/713 |
| 5,454,407 | A * | 10/1995 | Huza et al. | 141/10 |
| 5,588,811 | A * | 12/1996 | Price | 417/350 |
| 6,990,700 | B2 * | 1/2006 | Chung | 5/713 |
| 7,127,762 | B1 * | 10/2006 | Lau | 5/713 |

* cited by examiner

*Primary Examiner*—Timothy L. Maust
(74) *Attorney, Agent, or Firm*—Allston L. Jones

(57) ABSTRACT

An air pump assembly is disposed within an inflatable article, and includes a movable member. When the movable member is moved relative to a base to an inflating position, an outflow outlet in the base is closed, and an inflow valve is activated to open an inflow outlet in the base so as to permit air to be sucked into the inflatable article through an inflow inlet and the inflow outlet in the base by an air pump. When the movable member is moved to a deflating position, the inflow inlet is closed, and an outflow valve is activated to open an outflow inlet in the base so as to permit air to be forced out of the inflatable article through the outflow inlet and the outflow outlet.

8 Claims, 5 Drawing Sheets

AIR PUMP ASSEMBLY FOR INFLATING AND DEFLATING AN INFLATABLE ARTICLE

CROSS-REFERENCE TO RELATED APPLICATION

This application claims priority of Chinese Application No. 200420096575X, filed on Sep. 30, 2004.

BACKGROUND OF THE INVENTION

1. Field of the Invention

This invention relates to an air pump, and more particularly to an air pump assembly for inflating and deflating an inflatable article.

2. Description of the Related Art

Referring to FIG. 1, a conventional inflatable bed 1 is shown to include an inflatable body 11, an air inlet valve 12 disposed at an end wall of the inflatable body 11 so as to allow for inflow of air therethrough, an air outlet valve 13 disposed at an opposite end wall of the inflatable body 11 so as to allow outflow of air therethrough. Inflating equipment 14 is connected to the air inlet valve 12 in order to inflate the bed 1. The process of removing the inflating equipment 14 from its separately stored location, then connecting the inflating equipment 14 to the air inlet valve 12 results in a troublesome inflating process. Furthermore, when it is desired to deflate the bed 1, the bed 1 is pressed manually to discharge air. This is also a troublesome process.

SUMMARY OF THE INVENTION

The object of this invention is to provide an air pump assembly that is disposed in an inflatable article and that can be operated easily to inflate and deflate the article.

According to this invention, an air pump assembly is disposed within an inflatable article, and includes a movable member. When the movable member is moved relative to a base to an inflating position, an outflow outlet in the base is closed, and an inflow valve is activated to open an inflow outlet in the base so as to permit air to be sucked into the inflatable article through an inflow inlet and the inflow outlet in the base by an air pump. When the movable member is moved to a deflating position, the inflow inlet is closed, and an outflow valve is activated to open an outflow inlet in the base so as to permit air to be forced out of the inflatable article through the outflow inlet and the outflow outlet.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
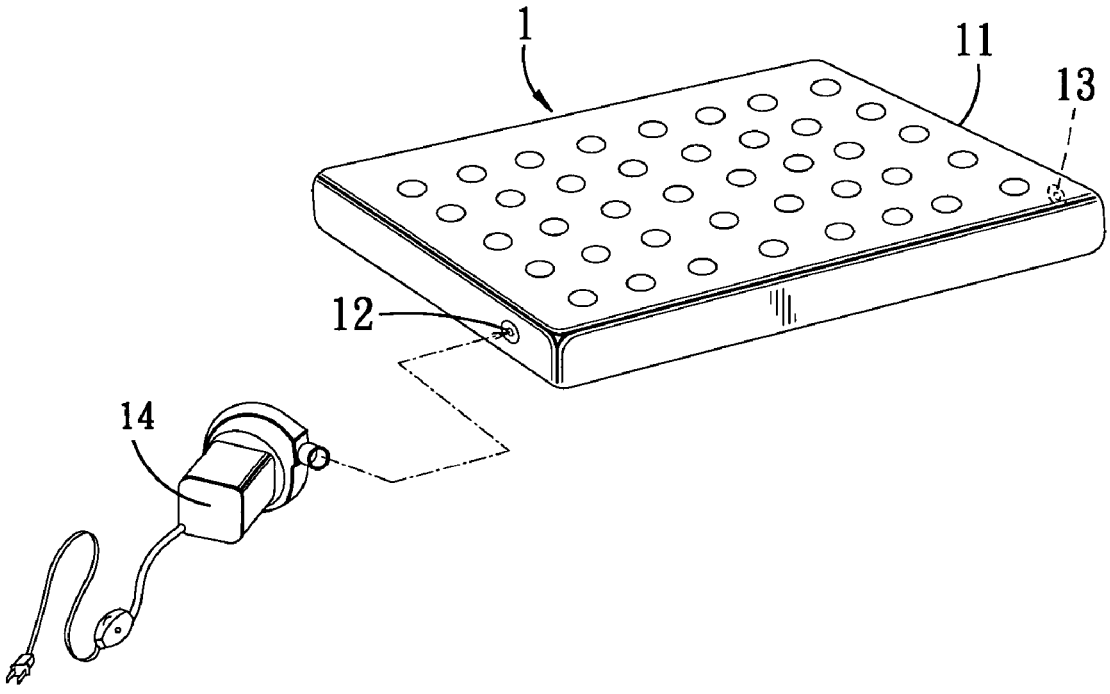
FIG. 1 PRIOR ART
FIG. 1 illustrates a conventional inflatable bed and equipment for inflating the conventional inflatable bed.
Figure 2:
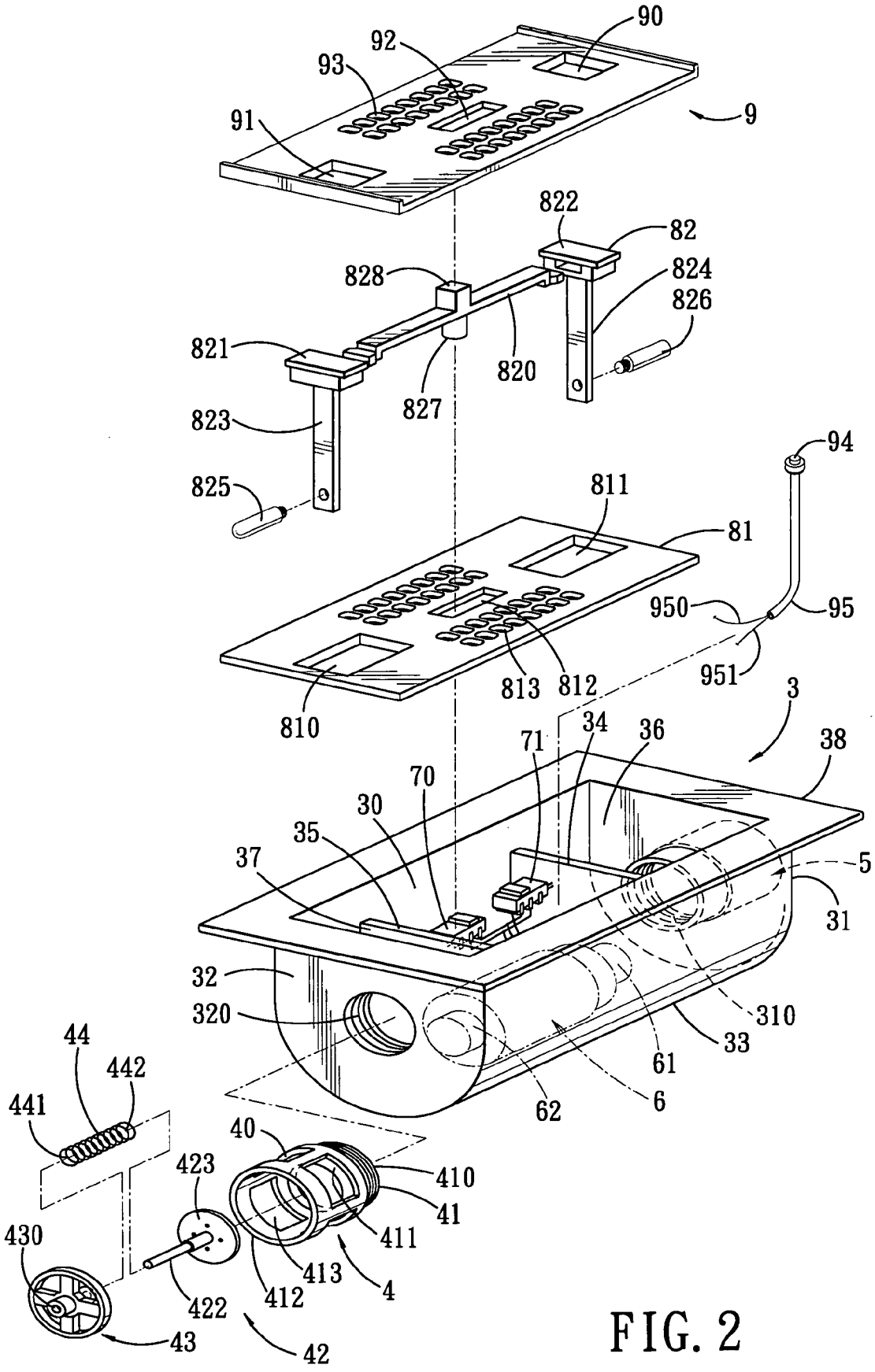
FIG. 2 is a partly exploded perspective view of the preferred embodiment of an air pump assembly for inflating and deflating an inflatable article according to this invention.
Figure 3:
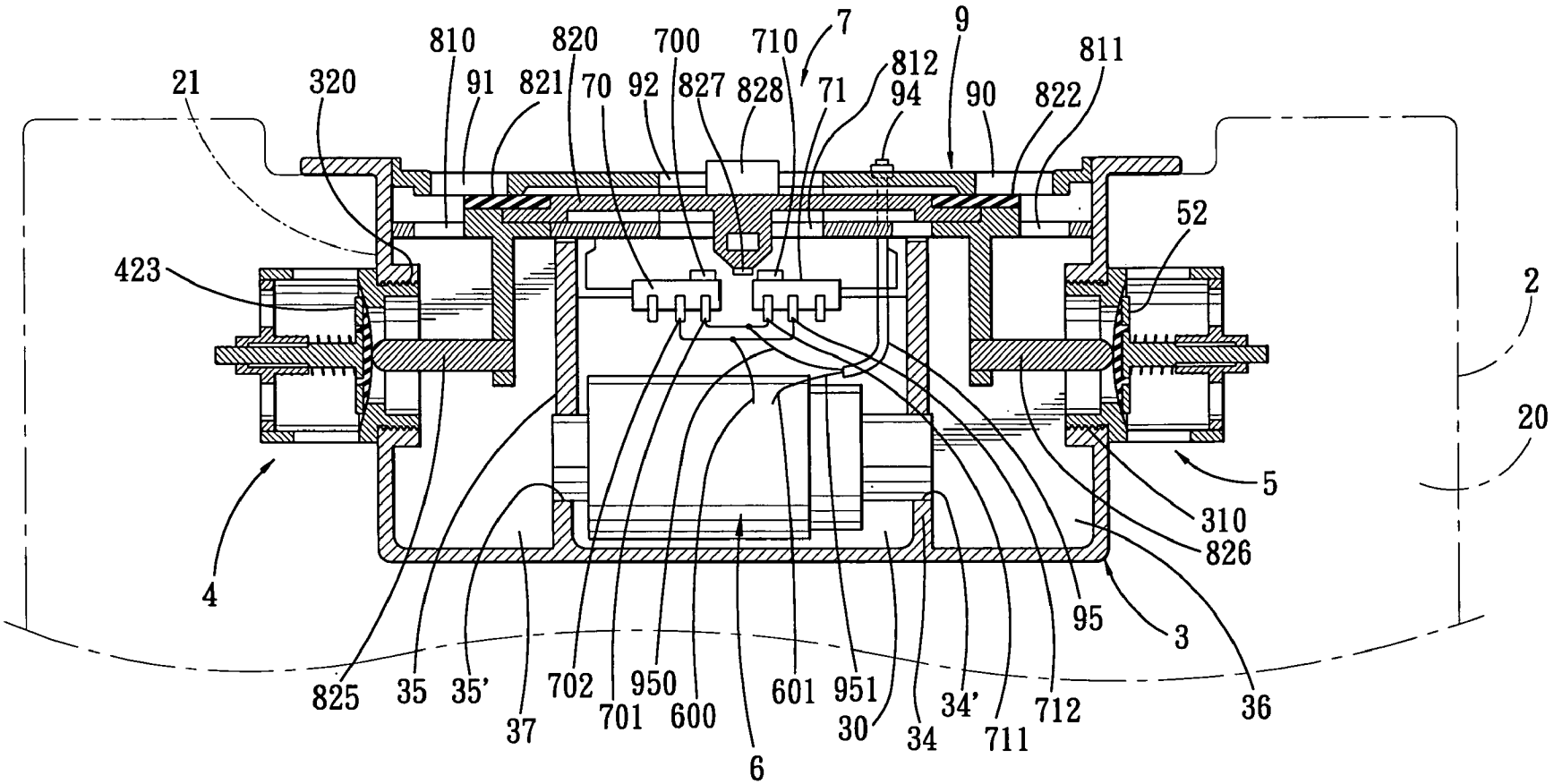
FIG. 3 is a sectional view of the preferred embodiment.

Referring to FIGS. 2 and 3, the preferred embodiment of an air pump assembly according to this invention is disposed in an inflatable article 2 (such as an inflatable bed), and is shown to include a base that includes a tub body 3, an inner plate 81 and an outer plate 9. The inflatable article 2 is formed with an interior chamber 20 and an aperture 21 in fluid communication with the interior chamber 20. The base is disposed within the aperture 21 in the inflatable article 2. The air pump assembly further includes an inflow valve assembly 4, an outflow valve assembly 5, an air pump 6, a control circuit 7 (see FIG. 3) and a movable member 82.

The tub body 3 includes a pair of opposite first and second end walls 31, 32 parallel to each other, and a U-shaped connecting wall 33 interconnecting the first and second end walls 31, 32 to define an accommodating chamber 30 among the first and second end walls 31, 32 and the connecting wall 33. A pair of parallel first and second partitions 34, 35 are fixed in the accommodating chamber 30, and are parallel to the first and second end walls 31, 32. The first partition 34 and the first end wall 31 define a first air chamber 36 therebetween. The second partition 35 is disposed between the first partition 34 and the second end wall 32 to define a second air chamber 37 between the second partition 35 and the second end wall 32. The top ends of the first and second partitions 34, 35 are spaced apart from a top end of the connecting wall 33, and are aligned with each other along a direction perpendicular to the first and second partitions 34, 35. An assembly of the connecting wall 33 and the first and second end walls 31, 32 is formed with a peripheral flange 38 extending outwardly from a top end thereof.

The inner plate 81 is received fittingly within a top end portion of the accommodating chamber 30, and abuts against the top ends of the first and second partitions 34, 35. As such, the first and second air chambers 36, 37 are located between the connecting wall 33 and the inner plate 81. The outer plate 9 is press-fitted within the top end portion of the accommodating chamber 30 in the tub body 3 so as to confine the inner plate 81 between the tub body 3 and the outer plate 9. Two opposite end portions of the outer plate 9 are formed respectively with an inflow inlet 90 and an outflow outlet 91, which are formed therethrough and which are in fluid communication with the first and second air chambers 36, 37, respectively. Therefore, air is able to flow into the first air chamber 36 through the inflow inlet 90, and out of the second air chamber 37 through the outflow outlet 91.

The first and second end walls 31, 32 are formed respectively with a threaded inflow outlet 320 and a threaded outflow inlet 310 that are in fluid communication with the second and first air chambers 37, 36, respectively. The inflow valve assembly 4 includes a tubular mounting member 41, an inflow valve 42, a valve-positioning element 43, and a coiled compression spring 44. The mounting member 41 has an externally threaded inner end 410 engaging the inflow outlet 320 in the second end wall 32 of the tub body 3 and having an inward flange 411 extending radially and inwardly therefrom, and an outer end 412 opposite to the inner end 410. A plurality of openings 413 are formed in the mounting member 41 between the inner and outer ends 410, 412. This allows for flow of air from the inflow outlet 320 in the tub body 3 into the interior chamber 20 in the inflatable article 2.

The inner end 410 of the mounting member 41 is disposed within the inflow outlet 320 in the tub body 3 as described above, and therefore is in fluid communication with the second air chamber 37 in the tub body 3 and the interior chamber 20 in the inflatable article 2. The inflow valve 42 includes a valve rod 422 and an outward flange 423 extending radially and outwardly from an end of the valve rod 422, and is disposed movably within the mounting member 41. The valve-positioning member 43 is press-fitted within the outer end 412 of the mounting member 41, and has a central hole 430 formed therethrough. The valve rod 422 of the inflow valve 42 extends through the central hole 430 in the valve-positioning element 43, and therefore is guided to move along an axial direction of the mounting member 41. The compression spring 44 is sleeved on the valve rod 422 of the inflow valve 42, and has a first end 441 abutting against the valve-positioning element 43, and a second end 442 abutting against the outward flange 423 of the inflow valve 42. Thus, the outward flange 423 of the inflow valve 42 is biased by the compression spring 44 to press against the inward flange 411 of the mounting member 41. As such, the inflow outlet 320 in the tub body 3 is closed so as to prevent flow of air from the second air chamber 37 in the tub body 3 into the interior chamber 20 in the inflatable article 2 through the inflow outlet 320.

The outflow valve assembly 5 is similar in construction to the inflow valve assembly 4, and is engaged with the outflow inlet 310 in the first end wall 31 of the tub body 3. Therefore, the outflow inlet 310 is closed so as to prevent flow of air from the interior chamber 20 in the inflatable article 2 into the first air chamber 36 in the tub body 3 through the outflow inlet 310.

The air pump 6 is disposed in the tub body 3 between the first and second partitions 34, 35, and has a first end 61 extending through a hole 34' in the first partition 34 and in fluid communication with the first air chamber 36, and a second end 62 extending through a hole 35' in the second partition 35 and in fluid communication with the second air chamber 37. The air pump 6 is provided with an electric fan (not shown) that can be controlled to rotate in a direction so as to force air to flow from the first end 61 to the second end 62.

The control circuit 7 is disposed in the tub body 3, and is connected electrically to the air pump 6. The control circuit 7 includes an inflow contact switch 70 and an outflow contact switch 71 that are disposed between the first and second partitions 34, 35. Each of the inflow contact switch 70 and the outflow contact switch 71 is provided with a pushbutton 700, 710. A positive pole 701 of the inflow contact switch 70 is connected electrically to a positive pole 711 of the outflow contact switch 71. A negative pole 600 of the air pump 6 is connected to both a negative pole 702 of the inflow contact switch 70 and a negative pole 712 of the outflow contact switch 71.

Each of the inner and outer plates 81, 9 is elongated, and has a guide slot 812, 92 formed through a middle portion thereof and extending along a longitudinal direction thereof, and a plurality of vent holes 813, 93 for heat dissipation. The inner plate 81 abuts against the top ends of the first and second partitions 34, 35, and further has two through holes 810, 811 formed respectively through two opposite end portions thereof. The first and second air chambers 36, 37 are defined between the inner plate 81 and the connecting wall 33 of the tub body 3 as described above.

The movable member 82 is disposed movably between the inner and outer plates 81, 9, and includes a rod body 820, a pair of first and second sealing elements 821, 822, two connecting strips 823, 824, a pair of first and second push rods 825, 826, a contact element 827 and an actuation element 828. The first and second sealing elements 821, 822 are attached respectively and fixedly to two opposite ends of the rod body 820. The connecting strips 823, 824 extend respectively, integrally, and transversely from the ends of the rod body 820. The connecting strip 823 extends through the through hole 810 in the inner plate 81 and into the second air chamber 37 in the tub body 3. The connecting strip 824 extends through the through hole 811 in the inner plate 81 and into the first air chamber 36 in the tub body 3. The first and second push rods 825, 826 are connected fixedly to and extend respectively from the connecting strips 823, 824 away from each other. The contact element 827 and the actuation element 828 extend from a middle portion of the rod body 820 away from each other. The contact element 827 extends through and is received slidably within the guide slot 812 in the inner plate 81 so as to guide the movable member 82 to move in a longitudinal direction of the inner plate 81. The actuation element 828 extends through and is received slidably within the guide slot 92 in the outer plate 9, and therefore can be manipulated to move the movable member 82 between an inflating position shown in FIG. 4 and a deflating position shown in FIG. 5.

The outer plate 9 is provided with an electrical socket 94 disposed fixedly thereon, and an electrical wire 95 connected to the electrical socket 94. The electrical wire 95 has a positive wire 950 connected to the positive pole 701 of the inflow contact switch 70 and the positive pole 711 of the outflow contact switch 71, and a negative wire 951 connected to the positive pole 601 of the air pump 6.

Figure 4:
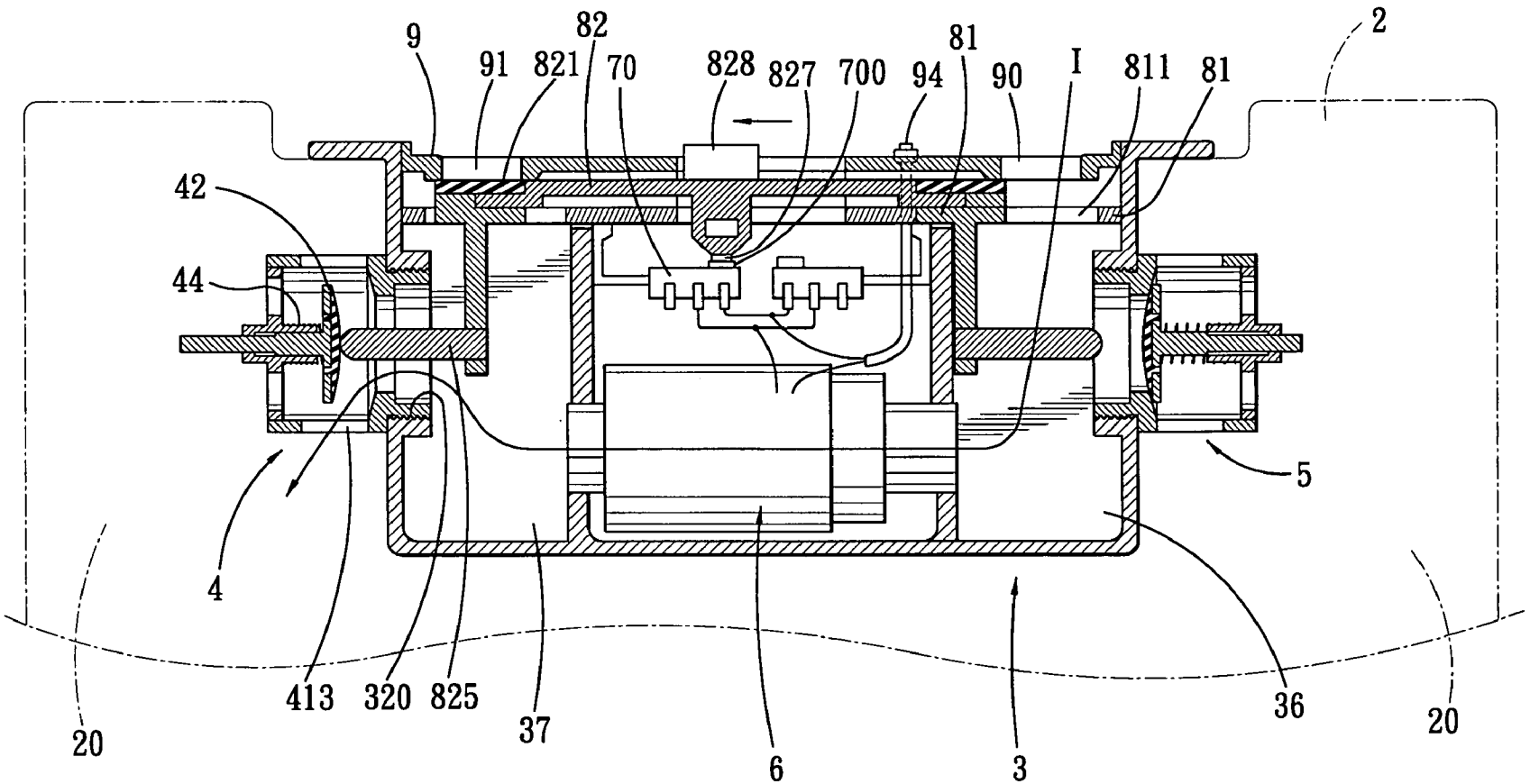
FIG. 4 is a sectional view of the preferred embodiment, illustrating an inflating position of a movable member.

Referring to FIG. 4, when an end of the actuation element 828 is manipulated so as to move the movable member 82 to the inflating position, the first sealing element 821 closes the outflow outlet 91 in the outer plate 9, and the first push rod 825 moves the inflow valve 42 to a non-sealing position so as to open the inflow outlet 320 in the tub body 3. At the same time, the contact element 827 pushes the pushbutton 700 of the inflow contact switch 70. Hence, the air pump 6 forces air to be sucked into the interior chamber 20 in the inflatable article 2 along a flow path (I) formed by the inflow inlet 90 in the outer plate 9, the through hole 811 in the inner plate 81, the first air chamber 36 in the tub body 3, the air pump 6, the second air chamber 37 in the tub body 3 and the inflow outlet 320 in the tub body 3.

Figure 5:
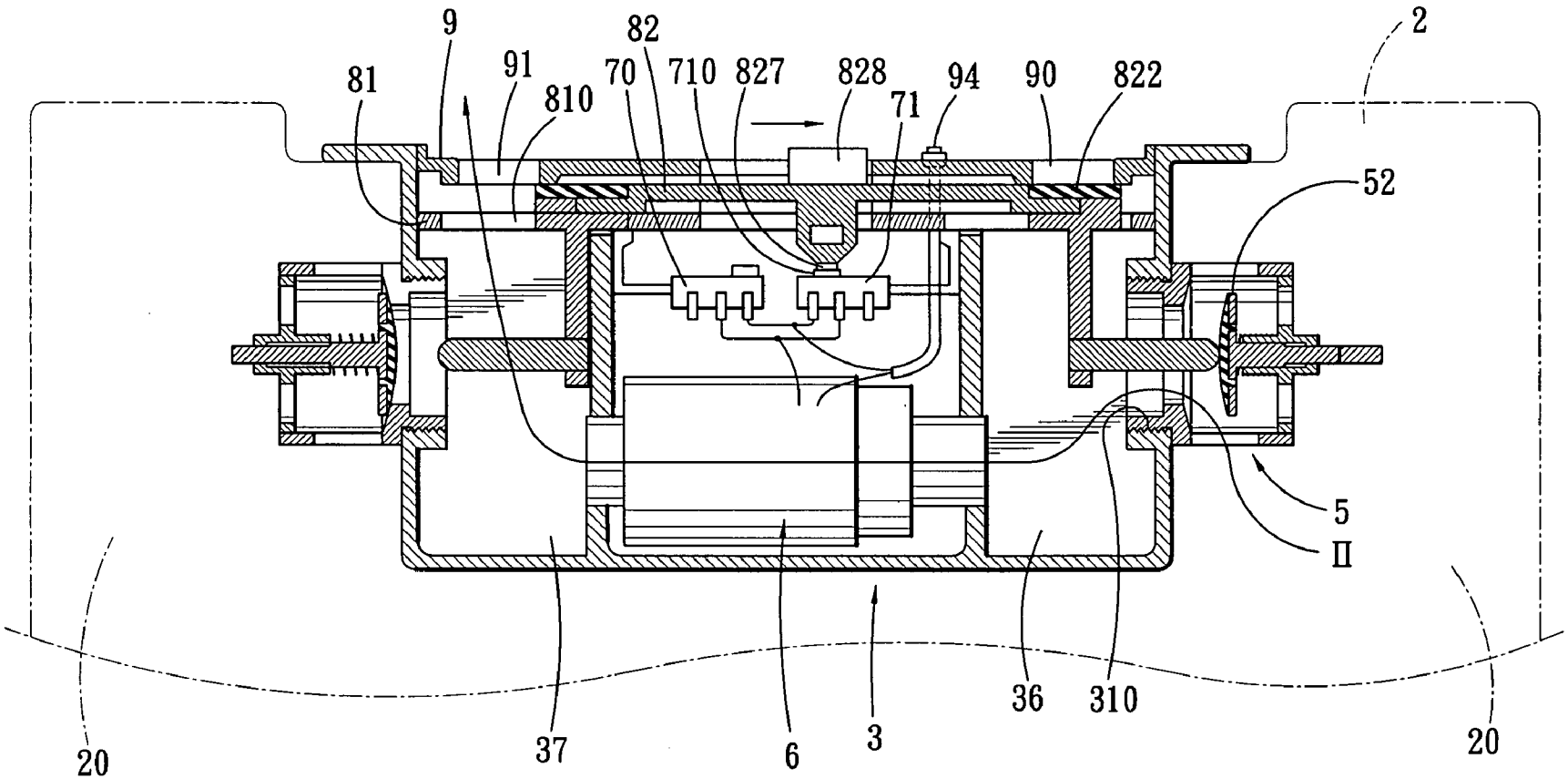
FIG. 5 is a sectional view of the preferred embodiment, illustrating a deflating position of the movable member.

Referring to FIG. 5, when the end of the actuation element 828 is manipulated to move the movable member 82 to the deflating position, the second sealing element 822 closes the inflow inlet 90 in the outer plate 9, and the second push rod 826 moves an outflow valve 52 of the outflow valve assembly 5 to a non-sealing position so as to open the outflow inlet 310 in the tub body 3. At the same time, the contact element 827 pushes the pushbutton 710 of the outflow contact switch 71. Hence, air is forced to flow out of the interior chamber 20 in the inflatable article 2 along a flow path (II) formed by the outflow inlet 310 in the tub body 3, the first air chamber 36 in the tub body 3, the air pump 6, the second air chamber 37 in the tub body 3, the through hole 810 in the inner plate 81 and the outflow outlet 91 in the outer plate 9.

Subsequently, when it is desired to discontinue deflation and fold the inflatable article 2, the movable member 82 is moved back to the position shown in FIG. 3. Therefore, the contact element 827 is not in electrical contact with the inflow contact switch 70 and the outflow contact switch 71. As a result, the rotation of the electrical fan (not shown) in the air pump 6 is interrupted so as to allow for folding of the inflatable article 2.

With this invention thus explained, it is apparent that numerous modifications and variations can be made without departing from the scope and spirit of this invention. It is therefore intended that this invention be limited only as indicated by the appended claims.

I claim:

1. An air pump assembly for inflating and deflating an inflatable article, the inflatable article being formed with an interior chamber and an aperture in fluid communication with the interior chamber, said air pump assembly comprising:

a base adapted to be mounted within the aperture in the inflatable article and including a pair of first and second air chambers, an inflow inlet in fluid communication with said first air chamber and adapted to permit flow of air into said first air chamber therethrough, an inflow outlet in fluid communication with said second air chamber and adapted to be in fluid communication with the interior chamber in the inflatable article, an outflow inlet in fluid communication with said first air chamber and adapted to be in fluid communication with the interior chamber in the inflatable article, and an outflow outlet in fluid communication with said second chamber and adapted to permit outflow of air from said second chamber therethrough;

an inflow valve disposed on said base and in proximity to said inflow outlet in said base and biased to close said outflow inlet so as to prevent flow of air from said base into the interior chamber through said inflow outlet;

an outflow valve disposed on said base and in proximity to said outflow inlet in said base and biased to close said outflow inlet so as to prevent flow of air from the interior chamber into said base through said outflow inlet;

an air pump disposed in said base between said first and second air chambers and in fluid communication with said first and second air chambers;

a control circuit disposed in said base and connected electrically to said air pump, said control circuit including an inflow contact switch and an outflow contact switch; and a movable member disposed movably on said base and movable between an inflating position, where said outflow outlet is closed, where said inflow valve is moved to a non-sealing position so as to open said inflow outlet, where said movable member contacts said inflow contact switch so that said air pump forces air to flow from said first air chamber into said second air chamber, and where air flows into the interior chamber in the inflatable article via a flow path formed by said inflow inlet, said first air chamber, said air pump, said second air chamber, and said inflow outlet, and a deflating position, where said inflow inlet is closed, where said outflow valve is moved to a non-sealing position so as to open said outflow inlet, where said movable member contacts said outflow contact switch so that said air pump forces air to flow from said first air chamber into said second air chamber, and where air flows out of the interior chamber in the inflatable article via a flow path formed by said outflow inlet, said first air chamber, said air pump, said second air chamber, and said outflow outlet.

2. The air pump assembly for inflating and deflating an inflatable article as claimed in claim 1, wherein said base further includes:

a tub body including a pair of opposite first and second end walls, a U-shaped connecting wall interconnecting said first and second end walls to define an accommodating chamber among said first and second end walls and said connecting wall, a first partition fixed in said accommodating chamber and parallel to said first and second end walls so as to define said first air chamber between said first end wall and said first partition, said first partition having a top end that is spaced apart from tha top ends of said connecting wall and said first and second end walls, a second partition fixed in said accommodating chamber between said first partition and said second end wall and parallel to said first partition so as to define said second air chamber between said second partition and said second end wall, said second partition having a top end that is aligned with said top end of said first partition in a direction perpendicular to said first and second partitions, and a peripheral flange extending outwardly from a top end of an assembly of said connecting wall and said first and second end walls;

an inner plate received fittingly within a top end portion of said accommodating chamber in said tub body and abutting against said top ends of said first and second partitions such that said first and second air chambers are located between said connecting wall and said inner plate; and an outer plate press-fitted within said top end portion of said accommodating chamber so as to confine said inner plate between said tub body and said outer plate, said inflow inlet and said outflow outlet being formed respectively through two opposite end portions of said outer plate.

3. The air pump assembly for inflating and deflating an inflatable article as claimed in claim 2, wherein said air pump, said inflow contact switch, and said outflow contact switch are disposed in said tub body between said first and second partitions.

4. The air pump assembly for inflating and deflating an inflatable article as claimed in claim 1, wherein said base includes a tub body that is formed with a pair of opposite first and second end walls, said outflow inlet in said base being formed through said first end wall, said inflow outlet being formed through said second end wall, said movable member being disposed movably between said inner and outer plates and being formed with a pair of fixed first and second push rods, said first push rod moving said inflow valve to said non-sealing position when said movable member is disposed at said inflating position, said second push rod moving said outflow valve to said non-sealing position when said movable member is disposed at said deflating position.

5. The air pump assembly for inflating and deflating an inflatable article as claimed in claim 4, wherein said inflow valve includes a valve rod and an outward flange extending radially and outwardly from an end of said valve rod, said air pump assembly further comprising:

a tubular mounting member having an inner end that is connected fixedly to said first end wall of said base and that is in fluid communication with said second air chamber in said base, and an outer end opposite to said inner end, said mounting member being formed with an inward flange that extends radially and inwardly from said inner end, said inflow valve being disposed movably within said mounting member;

a valve-positioning element disposed fixedly within said outer end of said mounting member and having a central hole formed therethrough, said valve rod of said inflow valve extending through said central hole in said valve-positioning element so as to guide said inflow valve to move along an axial direction of said mounting member; and a coiled compression spring sleeved on said valve rod of said inflow valve and disposed between said outward flange of said inflow valve and said valve-positioning element so as to bias said outward flange of said inflow valve to press against said inward flange of said mounting member so as to prevent flow of air through said inflow outlet in said base.

6. The air pump assembly for inflating and deflating an inflatable article as claimed in claim 1, wherein said movable member is formed with a fixed contact element, which comes into contact with said inflow contact switch when said movable member is disposed at said inflating position and with said outflow contact switch when said movable member is disposed at said deflating position.

7. The air pump assembly for inflating and deflating an inflatable article as claimed in claim 1, wherein said movable member is formed with a pair of first and second sealing elements, said first sealing element closing said outflow outlet in said base when said movable member is disposed at said inflating position, said second sealing element closing said inflow inlet in said base when said movable member is disposed at said deflating position.

8. The air pump assembly for inflating and deflating an inflatable article as claimed in claim 1, wherein said base further includes a tub body, an elongated outer plate disposed fixedly in said tub body, and an elongated inner plate disposed fixedly in said tub body and between said tub body and said outer plate, each of said inner and outer plates being formed with a guide slot that is formed therethrough and that extends along a longitudinal direction of a corresponding one of said inner and outer plates, said movable member being disposed movably between said inner and outer plates and being formed with an actuation element and a contact element that extend therefrom away from each other, said actuation element extending through said guide slot in said outer plate so that an end of said actuation element can be manipulated to move said movable member between said inflating position and said deflating position, said contact element extending through said guide slot in said inner plate and being movable to contact a selected one of said inflow contact switch and said outflow contact switch, said actuation element and said contact element being received respectively and slidably within said guide slots in said inner and outer plates so as to guide said movable member to move along the longitudinal direction of each of said inner and outer plates.

* * * * *